US006048213A

United States Patent [19]

Lai et al.

[11] Patent Number: 6,048,213

[45] Date of Patent: Apr. 11, 2000

[54] ELECTRICAL CONNECTOR ASSEMBLY

[75] Inventors: Spencer Lai, Shin-Juang, Taiwan; Robert G. Mchugh, Everygreen, Colo.

[73] Assignee: Hon Hai Precision Ind. Co., Ltd., Taipei Hsien, Taiwan

[21] Appl. No.: 09/022,170

[22] Filed: Feb. 11, 1998

[51] Int. Cl.[7] ..... H01R 9/09

[52] U.S. Cl. ..... 439/74; 439/660

[58] Field of Search ..... 439/74, 83, 660

[56] References Cited

U.S. PATENT DOCUMENTS

| | | | |
|---|---|---|---|
| 5,181,855 | 1/1993 | Mosquera et al. | 439/74 |
| 5,277,597 | 1/1994 | Masami et al. | 439/660 |
| 5,641,290 | 6/1997 | Yagi | 439/74 |
| 5,667,393 | 9/1997 | Grabbe et al. | 439/660 |
| 5,904,581 | 5/1999 | Pope et al. | 439/74 |

*Primary Examiner*—Renee S. Luebke
*Assistant Examiner*—T. C. Patel

[57] ABSTRACT

A board-to-board connector assembly for directly connecting a daughter board to a mother board includes a plug connector having an integrally formed dielectric housing with an outer wall, a bottom wall defining a first mating face and six ridges projecting from the first mating face. A number of first contacts are mounted to two sides of each of the ridges and extend through a bottom surface of the bottom wall for being directly soldered to the daughter board. A receptacle connector has an integrally formed dielectric housing with a second mating face, a bottom face opposite the second mating face and six grooves. A number of second contacts are mounted to the housing in side walls of the grooves and extend through the bottom surface for being directly soldered to the mother board. When the plug connector is connected to the receptacle connector, the ridges are received in the grooves, the first contacts engage with the second contacts, the first mating face abuts against the second mating face and the bottom surface of the receptacle connector is flush with a top surface of the outer wall of the plug connector.

8 Claims, 5 Drawing Sheets

ELECTRICAL CONNECTOR ASSEMBLY

BACKGROUND OF THE INVENTION

1. Field of The Invention

The present invention relates to an electrical connector assembly, and particularly to a board-to-board connector assembly including a plug connector and a receptacle connector for directly connecting a daughter board to a mother board.

2. The Prior Art

A board-to-board connector assembly is widely used in computers for directly connecting a daughter board to a mother board without requiring the use of a flat cable or other auxiliary device. The board-to-board connector assembly commonly includes a plug connector and a receptacle connector matingly engaged with each other. Each connector has an elongate, relatively slender housing with two rows of contacts extending therealong. Following the trend of high circuit density of electrical boards, connecting two electrical boards usually requires more than one connector assembly. To achieve this, conventionally, two or more receptacle connectors are firstly clamped together and then soldered to the mother board. A corresponding number of plug connectors are clamped together and then soldered to the daughter board. Thereafter, the mother and daughter boards are electrically connected by mating the plug and receptacle connectors.

However, it is troublesome to ensure that the connectors which are clamped together are uniformly level. Therefore, when the connectors are mated together, the contacts therein may have different degrees of engagement which leads to poor signal transmission between electrical boards. Furthermore, clamping the connectors together is laborious and inconvenient.

Hence, an improved board-to-board electrical connector assembly is needed to eliminate the above mentioned defects of current board-to-board electrical connector assemblies.

SUMMARY OF THE INVENTION

Accordingly, an objective of the present invention is to provide a board-to-board connector assembly having a receptacle and plug connector which can replace a number of conventional board-to-board plug and receptacle connectors without requiring any clamping operation.

Another objective of the present invention is to provide a board-to-board connector assembly having a receptacle and plug connector each of which can function to replace a number of conventional board-to-board plug and receptacle connectors, while when the receptacle and plug connectors in accordance with the present invention are connected together, a consistent degree of engagement between the contacts thereof can be maintained.

To fulfill the above mentioned objectives, according to one aspect of the present invention, a board-to-board electrical connector assembly for directly connecting a daughter board to a mother board includes a plug connector and a receptacle connector.

The plug connector has an integrally formed, rectangular dielectric housing with an outer wall, a bottom wall defining a first mating face and a bottom face opposite the first mating face, two daughter board mounting posts respectively extending downward from two diagonal corners of the bottom face for fitting in two holes defined in the daughter board, and six equidistantly spaced ridges projecting from the first mating face within the outer wall. Each ridge has an end surface which together define a second mating face. A number of first contacts are mounted to two sides of each of the ridges and extend through the bottom face of the bottom wall to be directly soldered to the daughter board by UV radiation.

The receptacle connector has an integrally formed, rectangular dielectric housing with a third mating face about its top surface, a bottom surface opposite the third mating face and six grooves defined in the top surface. The housing of the receptacle connector further defines a fourth mating face at a base of each of the grooves. A number of second contacts are mounted to the housing in side walls of the grooves and extend through the bottom surface to be directly soldered to the mother board by UV radiation.

When the plug connector is connected to the receptacle connector, the ridges are received in the grooves, the first contacts engage with the second contacts, the first mating face abuts against the third mating face, the second mating face abuts against the fourth mating face, and the bottom surface of the receptacle connector is flush with a top surface of the outer wall of the plug connector.

DETAILED DESCRIPTION OF THE PREFERRED EMBODIMENTS

Reference will now be made in detail to the preferred embodiment of the present invention.

Figure 1:
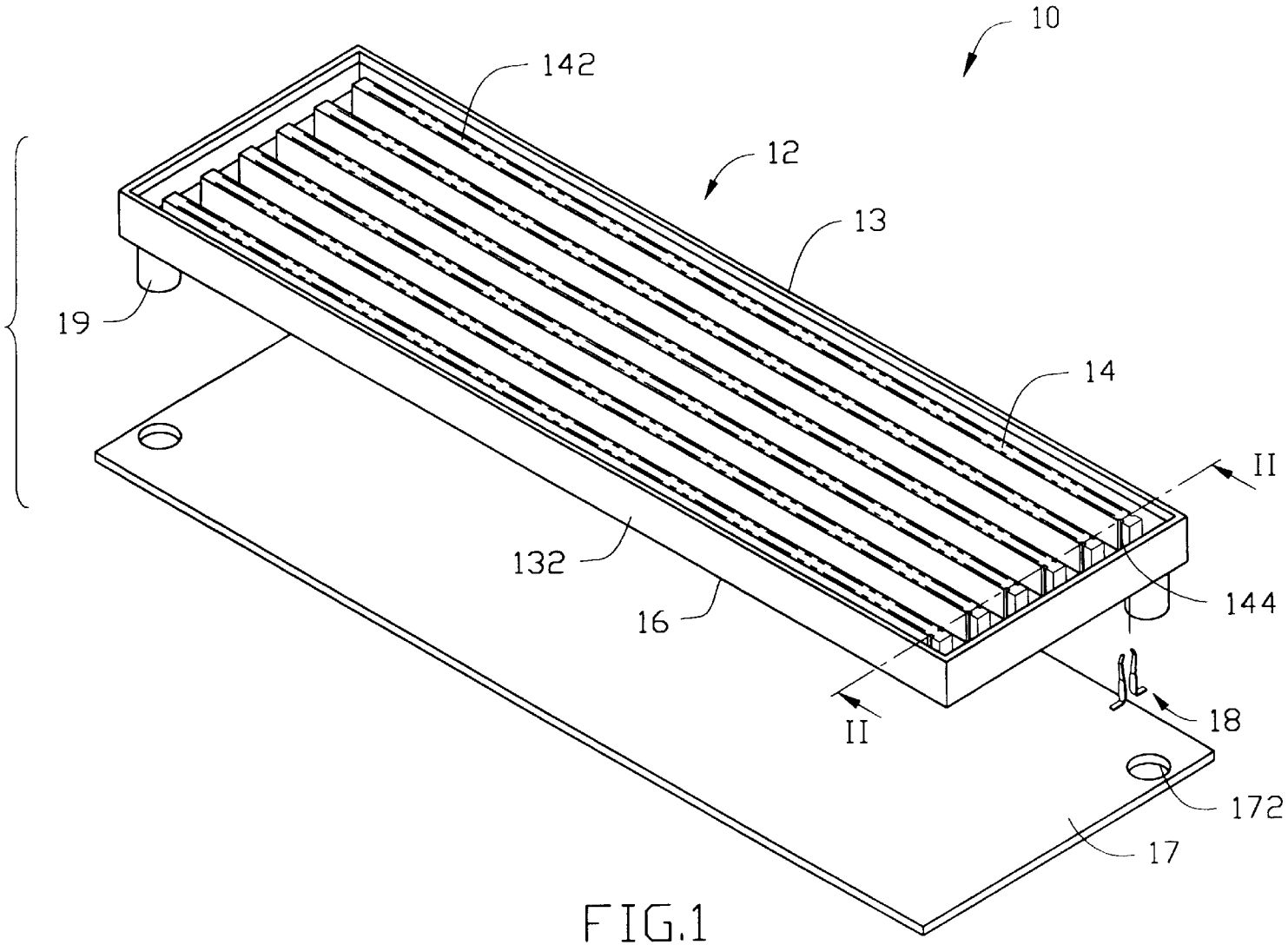
FIG. 1 is an exploded, perspective view showing a board-to-board plug connector in accordance with the present invention and a daughter board.
Figure 2:
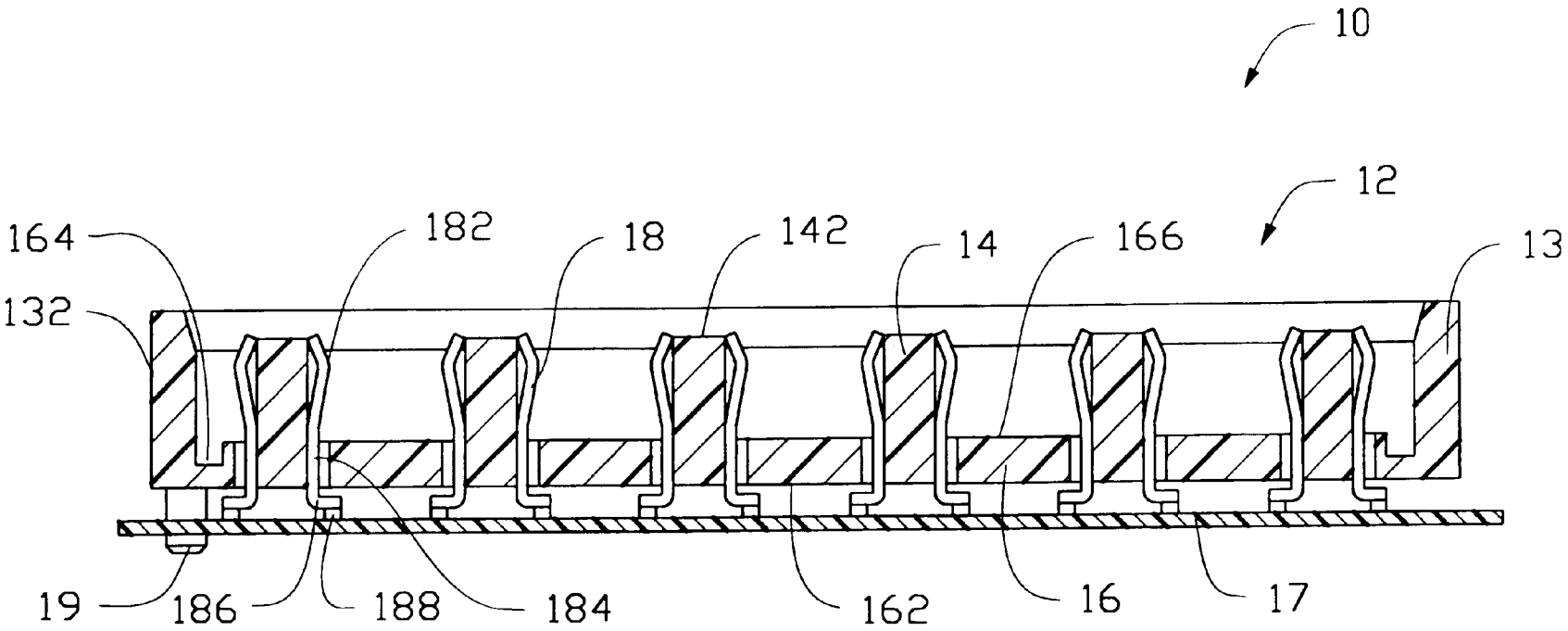
FIG. 2 is an enlarged cross-sectional view taken along line 2—2 of FIG. 1, showing the plug connector assembled with the daughter prior to being subject to UV radiation.

Referring to FIGS. 1 and 2, a board-to-board plug electrical connector 10 in accordance with the present invention consists of a rectangular dielectric housing 12 formed by plastic injection molding and a number of contacts 18 formed by stamping a metal sheet. The housing 12 is integrally formed with a rectangular outer wall 13, a bottom wall 16, and six equidistantly spaced ridges 14 projecting from the bottom wall 16 within the outer wall 13.

The bottom wall 16 is formed having a uniform thickness so that a first connector mating face 166 defined by a top surface of the bottom wall 16 is uniformly level when the housing 12 is positioned horizontally. Furthermore, each ridge 14 is formed to project from the bottom wall 16 an equal distance so that a second connector mating face 142 defined by top surfaces of the ridges 14 are uniformly level when the housing 12 is positioned horizontally. Two locating trenches 164 are defined in the bottom wall 16 near two longitudinal sides 132 of the outer wall 13, respectively.

The plug connector 10 has six ridges 14 which function as six conventional board-to-board plug connectors clamped together. Although the preferred embodiment has six ridges 14, it is understood that the present invention is not limited as such. A number of contact passages 144 are vertically defined in two-sides of each of the ridges 14 and through the bottom wall 16. Each contact 18 is formed with a contact portion 182, an interference portion 184, a tail portion 186 and a slug solder 188 attached to a bottom of the tail portion 186. A pair of electrical board mounting posts 19 extend downward from two diagonal corners of the bottom wall 16, respectively.

To assemble the contacts 18 in the housing 12, each contact 18 is inserted from a bottom surface 162 of the bottom wall 16 through the bottom wall 16 into a corresponding contact passage 144 to reach a position where the interference portion 184 interferentially engages with the bottom wall 16, the tail portion 186 is located below the bottom face 162 and the contact portion 182 is received in the contact passage 144.

Thereafter, the plug connector 10 is mounted to a daughter board 17 by respectively fitting the mounting posts 19 into two holes 172 defined in the daughter board 17 and then subjecting the plug connector 10 together with the daughter board 17 to UV radiation to melt the slug solder 188 thereby mechanically and electrically connecting the plug connector 10 to the daughter board 17.

Figure 3:
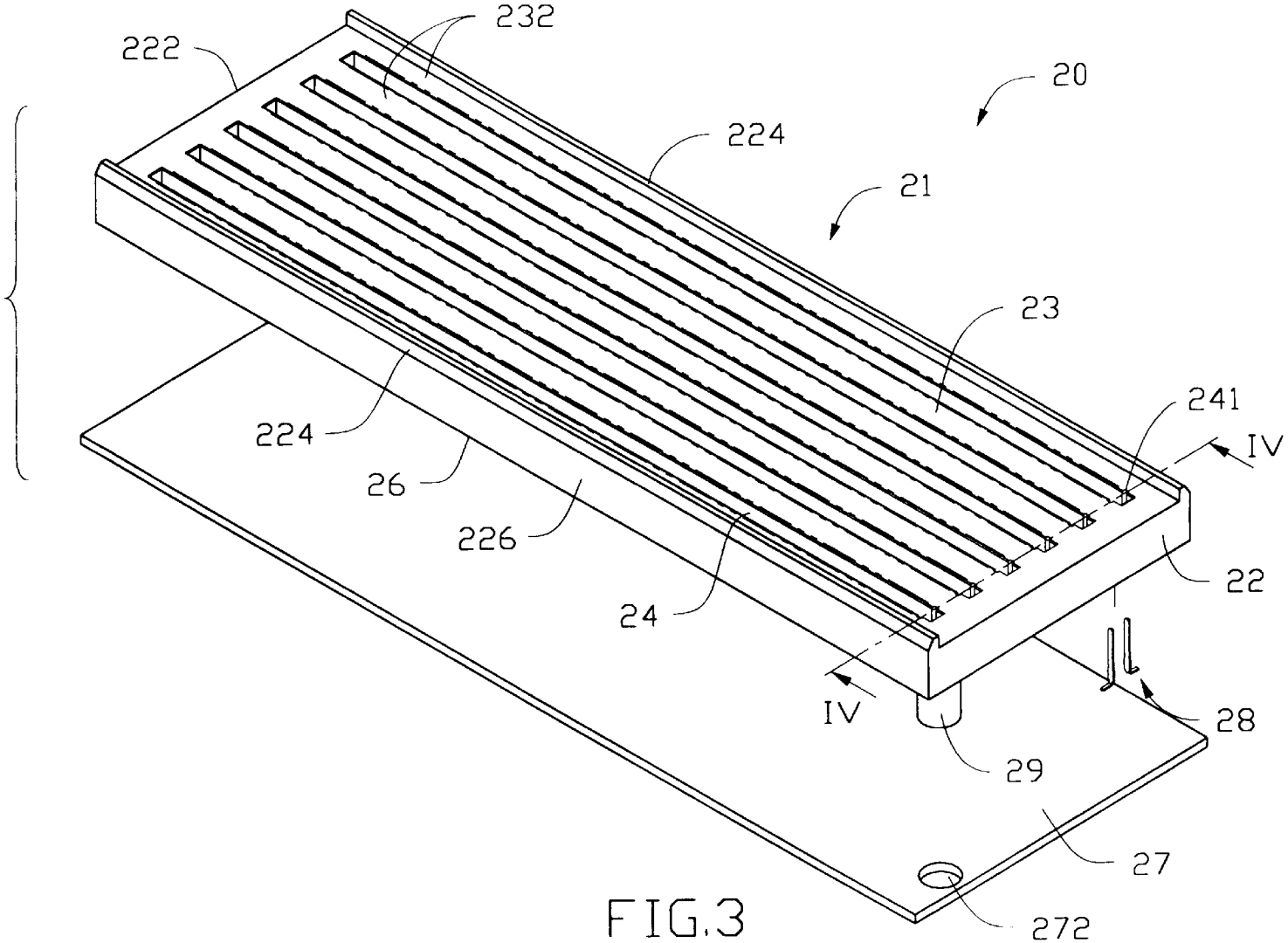
FIG. 3 is a view similar to FIG. 1, showing a board-to-board receptacle connector in accordance with the present invention and a mother board in a reduced scale.
Figure 4:
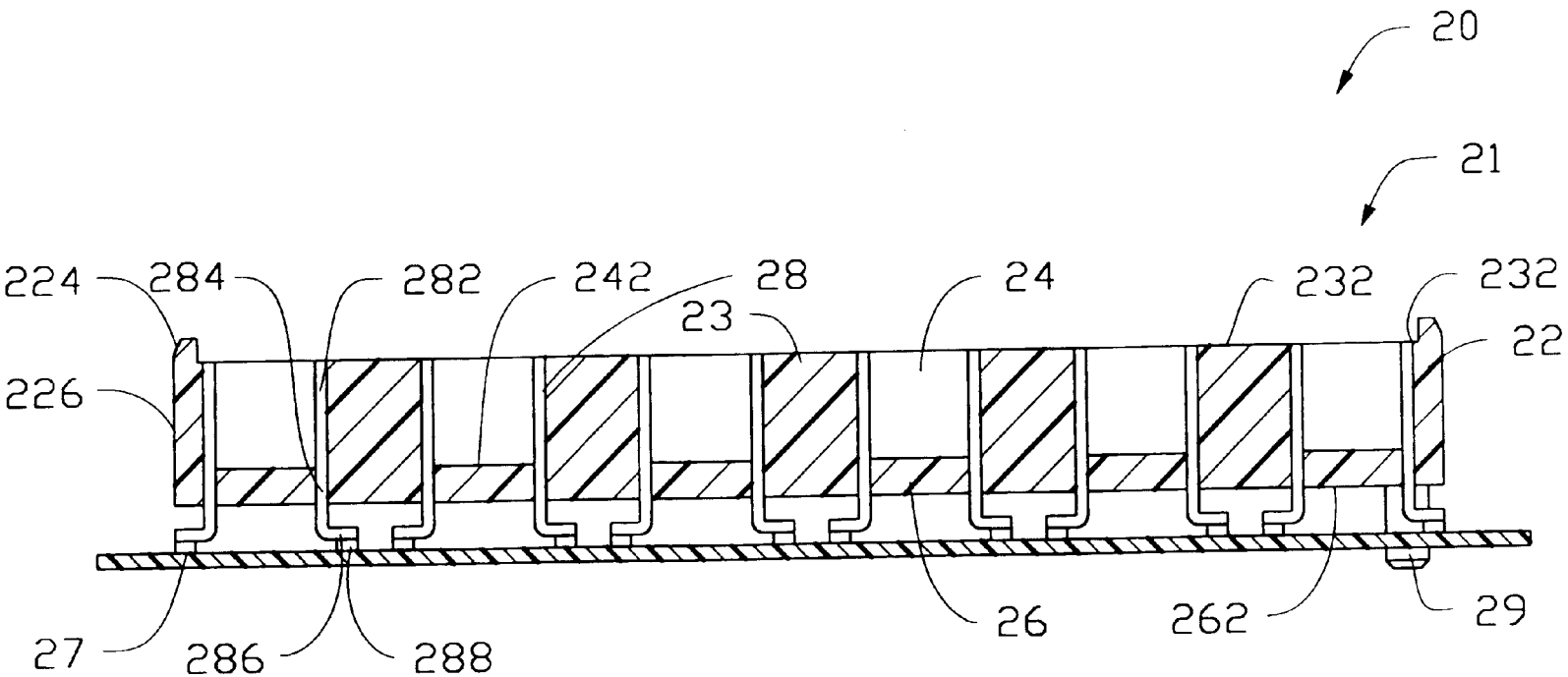
FIG. 4 is an enlarged cross-sectional view taken along line 4—4 of FIG. 3, showing the receptacle connector assembled with the mother board prior to being subject to UV radiation.

Referring to FIGS. 3 and 4, a board-to-board receptacle electrical connector 20 in accordance with the present invention generally includes a rectangular dielectric housing 21 formed by plastic injection molding, and a number of contacts 28 formed by stamping a metal sheet. The housing 21 is integrally formed with an outer wall 22 and five partition walls 23 extending longitudinally between two lateral sides 222 of the outer wall 22 thereby defining six equidistantly spaced elongate grooves 24 in the housing 21.

A number of contact passages 241 are vertically defined in side walls of the grooves 24 and longitudinal sides 226 of the outer wall 22 and further defined through a bottom wall 26. Two mother board mounting posts 29 extend downward from two diagonal corners of a flat bottom surface 262 of the bottom wall 26 of the housing 21, respectively.

Each partition wall 23 and the outer wall 22 has a top surface defining a third connector mating face 232 which is equidistantly spaced from the bottom surface 262 so that when the housing 21 is positioned horizontally, the third connector mating face 232 is uniformly level. The housing 21 further defines a fourth connector mating face 242 at a base of the grooves. The fourth mating face 242 is equidistantly spaced from the bottom surface 262 so that when the housing 21 is positioned horizontally, the fourth mating face 242 is uniformly level. Two locating projections 224 are formed along the top surface of the two longitudinal sides 226 of the outer wall 22, respectively.

Each contact 28 is formed with a contact portion 282, an interference portion 284, a tail portion 286 and a slug solder 288 attached to a bottom face of the tail portion 286. To mount the contacts 28 in the housing 21, each contact 28 is inserted from the bottom surface 262 through the bottom wall 26 into a corresponding contact passage 241 to reach a position where the contact portion 282 is received in the contact passage 241, the interference portion 284 interferentially engages with the bottom wall 26 and the tail portion 286 is located below the bottom surface 262.

Thereafter, the receptacle connector 20 is mounted to a mother board 27 by respectively fitting the mounting posts 29 through two holes 272 defined in the mother board 27 and then subjecting the receptacle connector 20 together with the mother board 27 to UV radiation to melt the slug solder 288 thereby mechanically and electrically connecting the receptacle connector 20 to the mother board 27.

Figure 5:
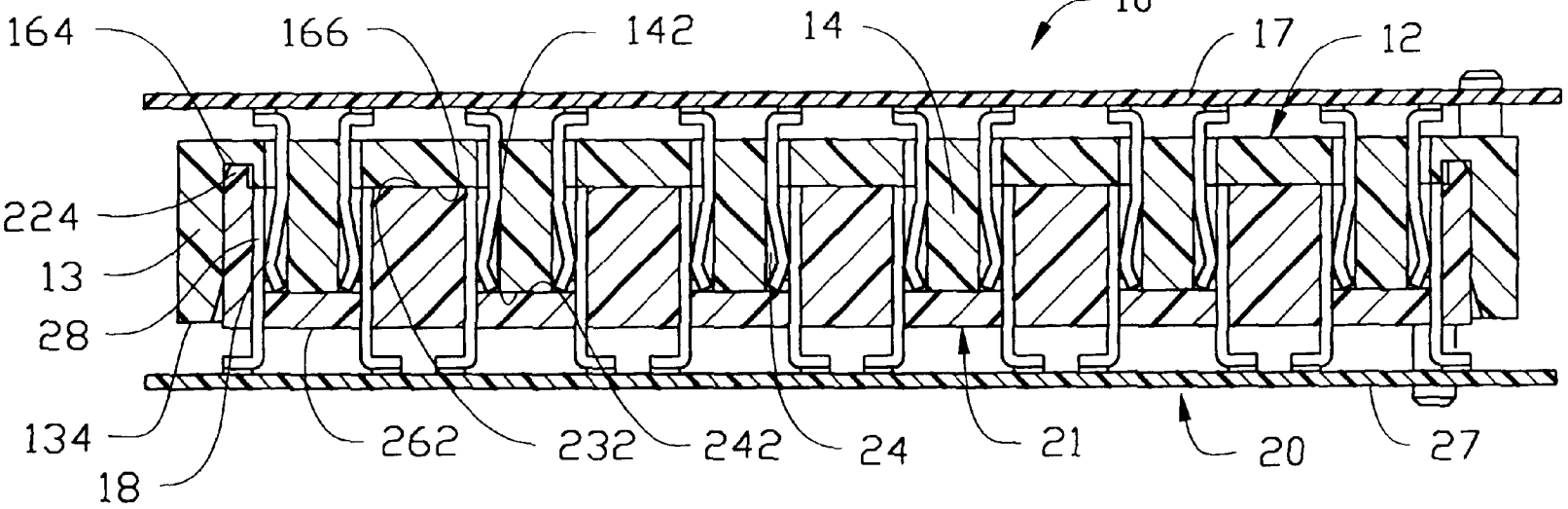
FIG. 5 is a cross-sectional view showing the connectors soldered to the corresponding electrical board and mated together.

Now referring to FIG. 5, the plug connector 10 is brought to mate with the receptacle connector 20 to enable electrical signals to be transmitted between the daughter board 17 and the mother board 27. To mate the connectors 10, 20 the locating projections 224 are inserted into the locating trenches 164 to reach a position in which the bottom face 262 of the receptacle connector 20 is flush with a top face 134 of the outer wall 13 of the plug connector 10, the first mating face 166 abuts against the third mating face 232, and the second mating face 142 abuts against the fourth mating face 242. Since the first and third mating faces 166, 232, and second and fourth mating faces 142, 242 are formed to abut against each other, respectively, when the two connectors 10, 20 are matingly engaged, a consistent degree of engagement is maintained for the contacts 18, 28 in different ridges 14 and grooves 24. Furthermore, since the housings 12, 21 are integrally formed wherein each housing 12, 21 includes integrally the outer wall 13, 22 and the inner ridges 14 or the partition wall 23, the present invention does not require any clamping device and also simplifies the manufacturing and assembling matters.

It is also noted that to achieve the low profile of the assembly, the outer wall 22 of the housing 21 of the receptacle connector 20 is substantially received within the outer wall 13 of the housing 12 of the plug connector 10. Therefore, the dimension in either the lengthwise direction or the lateral direction of the housing 21 of the receptacle connector 20 is smaller than that of the housing 12 of the plug connector 10. Thus, the posts 29 of the receptacle connector 20 is closer to the center point of the assembly in comparison with the posts 19 of the plug connector 10. Accordingly, the holes 272 in the board 27 own the same relationship relative to the holes 172 in the board 17, and that assures the correct installation of the connectors 10, 20 to the boards 17, 27, respectively. Under this situation, the distance between the pair of posts 29 of the receptacle connector 20 is smaller than that between the pair of the posts 19 of the plug connector 10.

While the present invention has been described with reference to the specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

We claim that:

1. A board-to-board electrical connector assembly, comprising:

a plug connector, comprising:

a first dielectric housing having:

a first outer wall;

a first bottom wall integrally formed with the first outer wall;

at least two elongate ridges integrally projecting from the first bottom wall and located within the first outer wall; and a number of first contact passages vertically defined in two sides of each of the ridges and through the first bottom wall;

a number of first contacts each having a first contact portion received in a corresponding first contact passage and a first interference portion interferentially engaged with the first bottom wall; and a receptacle connector, comprising:

a second dielectric housing having:

a second outer wall;

a second bottom wall integrally formed with the second outer wall;

at least a partition wall integrally projecting from the second bottom wall and located within the second outer wall to define at least two grooves with the second outer wall; and a number of second contact passages defined in both the second outer wall and the partition wall, and through the second bottom wall;

a number of second contacts each having a second contact portion received in a corresponding second contact passage and a second interference portion interferentially engaged with the second bottom wall;

wherein when the plug connector is connected to the receptacle connector, the ridges are received in the corresponding grooves and the first contacts engage with the corresponding second contacts, the first bottom wall of the plug connector having a top surface defining a first mating face, the second outer wall and partition wall of the receptacle connector having top surfaces defining a second mating face, wherein when the plug connector is connected to the receptacle connector, the first mating face abuts against the second mating face, the first bottom wall of the plug connector defining a locating trench below the first mating face and near the first outer wall and the second outer wall of the receptacle connector comprising a locating projection protruding from the top surface thereof, when the plug connector is connected to the receptacle connector, the projection being received in the trench to abut against the first bottom wall of the plug connector.

2. The connector assembly in accordance with claim 1, wherein the first outer wall of the plug connector has a rectangular shape with two longitudinal sides and two lateral sides, and wherein the locating trench is defined near one of the longitudinal sides of the first outer wall.

3. The connector assembly in accordance with claim 1, wherein the ridges of the plug connector have top surfaces defining a third mating face and the second bottom wall of the receptacle connector has a top surface defining a fourth mating face, and wherein when the plug connector is connected to the receptacle connector, the third mating face abuts against the fourth mating face.

4. The connector assembly in accordance with claim 1, wherein the second bottom wall of the receptacle connector has a bottom surface and the first outer wall of the plug connector has a top surface, and wherein when the plug connector is connected to the receptacle connector, the bottom surface of the second bottom wall of the receptacle connector is flush with the top surface of the first outer wall of the plug connector.

5. The connector assembly in accordance with claim 1, wherein each of the first and second bottom walls of the plug and receptacle connectors has a rectangular shape with two electrical board mounting posts extending downward from two diagonal corners of each of the first and second bottom walls, respectively.

6. The connector assembly in accordance with claim 1, wherein each of the contacts of the plug and receptacle connectors has a tail portion extending below the bottom walls thereof, each tail portion having a bottom face attached with slug solder which melts when subject to UV radiation.

7. A combination of electrical boards and electrical connectors, comprising:

a first connector having:

an integrally formed first dielectric housing forming an outer wall, a bottom wall connected with the outer wall and having a first connector mating face and a first bottom surface opposite the first mating face, and a number of ridges projecting from the first mating face; and a number of first contacts mounted to each side of each of the ridges, each first contact having a tail portion extending below the first bottom surface of the bottom wall;

a first electrical board directly connected to the tail portions of the first contacts;

a second connector connected to the first connector, having:

an integrally formed second dielectric housing defining a second connector mating face abutting against the first mating face, a second bottom surface opposite the second connector mating face, and a number of grooves receiving the ridges of the first connector; and a number of second contacts mounted in side walls of the grooves of the second housing, each of the second contacts having a contact portion engaging with a corresponding one of the first contacts and a tail portion extending below the second bottom surface of the second housing; and a second electrical board directly connected to the tail portions of the second contacts;

wherein the bottom wall of the first housing defines a locating trench below the first mating face and near the outer wall and the second housing forms a locating projection protruding from the second mating face, said locating projection being received in the locating trench.

8. The combination in accordance with claim 7, wherein each of the ridges has an end surface abutting against a surface of the second housing at a base of each of the grooves.

* * * * *